United States Patent [19]

Sarles et al.

[11] Patent Number: 4,920,679

[45] Date of Patent: May 1, 1990

[54] FIREARM WITH DETACHABLE BARREL

[76] Inventors: J. Stephen Sarles; L. P. Thompson, Jr., both of Bldg. D, 412 Space Park South, Nashville, Tenn. 37211

[21] Appl. No.: 247,386

[22] Filed: Sep. 21, 1988

[51] Int. Cl.[5] ..... F41C 21/22

[52] U.S. Cl. ..... 42/75.02

[58] Field of Search ..... 42/75.02, 77

[56] References Cited

U.S. PATENT DOCUMENTS 446,807 2/1891 Armit .
529,455 11/1894 Marlin .
1,994,489 3/1935 Simpson .
2,115,861 5/1938 Laloux .
2,149,707 3/1939 Murbach .
2,632,272 3/1953 Holek .
4,644,930 2/1987 Mainhardt .

*Primary Examiner*—Charles T. Jordan
*Assistant Examiner*—Richard W. Wendtland

[57] ABSTRACT

A firearm has a removal barrel assembled by rotably threading the barrel onto the barrel extension until a blocking surface on the barrel abuts a resistance surfacee on the extension to inhibit further rotation.

13 Claims, 1 Drawing Sheet

FIREARM WITH DETACHABLE BARREL

Figure 2:
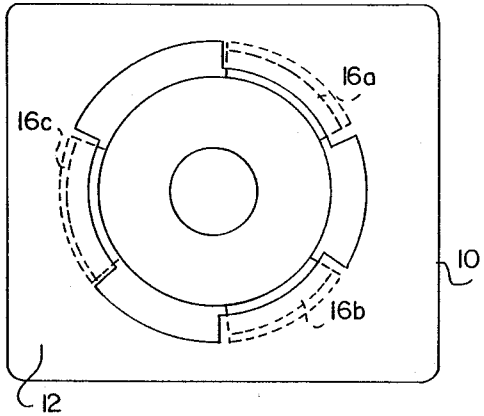

The present invention relates generally to weapons such as automatic firearms and, more particularly, to a quick change, exchangeable barrel and associated mounting for such a barrel for use in firearms.

BACKGROUND OF THE INVENTION

Conventional automatic type firearms, particularly air-cooled automatic firearms, have a serious operational limitation in that the firearm barrel can easily overheat when firing long continuous bursts of ammunition. Thus, after a period of continuous use, a firearm such as a machine gun must be taken out of operation unless long, continuous bursts have been avoided. Otherwise, malfunction or permanent damage to the firearm may result. Various remedies have been proposed to overcome the overheating problem in such firearms, the most satisfactory remedy being simply to exchange the overheated barrel for another barrel which is at ambient or reduced temperature.

While this practice of exchanging barrels tends to eliminate the overheating problem of automatic firearms, it introduces an additional operational limitation in terms of the time required to change barrels which, of course, renders the firearm inoperative during the period of time in which changing of the barrels is effected. Thus, the hot barrel of the firearm should be easily detachable and the new barrel should be quickly attachable. Moreover, the barrel must be able to provide the proper headspacing of the firearm due to the accumulation of manufacturing tolerances which affect the headspace. Variations in headspace cause the distance from the head of a cartridge seated in the chamber of the barrel to the bolt to vary to such a degree that, on one hand, the bolt may not be closed on a cartridge and thus the firearm cannot be fired, and on the other, the face of the bolt does not support the head of the cartridge and as a consequence the cartridge case may rupture when fired.

Barrels of the exchangeable type for use with automatic firearms and the like have utilized an interrupted type of thread, that is, several portions of the threads on one end of the barrel and in the breech are interrupted to allow an axial sliding assembly of the two components and then allow a small rotational movement to lock them together. The thread interruptions are usually spaced about the barrel and breech, three interruptions being the most common spacing arrangement.

As an improvement in this art, it is an object of the present invention to provide an exchangeable barrel and barrel mounting or extension, which allows the mounting and barrel to be joined and separated quickly and easily, and in which joinder is effected consistently and to the same position every time. Expressed otherwise, it is a feature of this invention to provide a barrel and mounting which, as joined, will form a headspace that will not vary on each assembly of the barrel on the mounting and will remain constant despite repeated firing of the weapon.

It is another object of the present invention to provide a barrel and mounting which cooperate in such a manner that the barrel is maintained against accidental changes in headspace of the firearm, such as by further rotation of the barrel to move the barrel axially toward or away from the barrel mounting.

SUMMARY OF THE INVENTION

In its more basic aspects, the present invention is directed to a firearm that includes barrel adapted for facile mounting on and removal from the breech of the weapon. As part of the breech, a barrel extension extends outwardly and terminates in a resistance surface. That resistance surface has a bore formed therein and extending inwardly therefrom, which bore has spaced around its periphery internal threads interrupted to form a plurality of thread segments separated from each other by threadless portions.

As a separate part, the claimed combination includes a barrel that terminates at one end in a portion protruding axially therefrom and defining a blocking surface at its juncture with the barrel end. The barrel protrusion carries on its periphery external threads interrupted by threadless portions to form a plurality of thread segments that extend outwardly from the periphery of the barrel protrusion. The thread segments of the barrel protrusion are sized to complement the threadless portions of the barrel extension bore, so that the threaded end of the barrel can be inserted into the bore of the barrel extension by aligning the thread segments of one with the threadless portions of the other.

Moreover, the thread segments of the barrel and the barrel extension bore are so constructed that when the barrel is in the extension bore, upon relative rotation of the barrel and barrel extension, the helical thread segments of each engage each other and the barrel and barrel extension are movable axially together to a position in which the extension resistance surface and the barrel blocking surface are contiguous. At this point no further substantial rotation or axial movement between the barrel and barrel extension can take place.

From this basic statement of the invention, there are other improvements that also comprise part of the present invention. Thus, advantageously the thread segments of the barrel extension bore and barrel protrusion should be spaced asymmetrically from each other. More preferably, the thread segments of each are three in number, two of which describe the same arc and the third of which describes a greater arc. In order to effect insertion of the barrel and the barrel extension bore, this will require that the greater threaded portion, i.e., the one that describes the greater arc, will require on its opposite member a threadless portion defining such greater arc. More preferably, the greater thread segment on either the barrel extension bore or the barrel protrusion will describe an arc of about 62.5°, and the other two thread segments on that part will describe arcs of about 60°. Also, in the present invention the most preferred form of threads are helical threads.

In a further aspect, the present invention contemplates an additional means to prevent rotation of the barrel and barrel extension with respect to each in either direction, i.e., after the barrel and barrel extension have been rotated so that the threads cooperate to the fullest and no further rotation is possible because the resistance surface of the barrel extension and the blocking surface of the barrel are in contiguity, locking means are employed to maintain the barrel and barrel extension in that position, e.i., during firing thereof. That locking means comprises a male part extending from the barrel extension and into contact with a cooperating female part on the barrel. Preferably, the male member on the barrel extension extends from the barrel extension into a series of grooves formed along the periphery of the barrel. More preferably, a means is provided to inhibit accidental release of the male member from the groove, such as spring biasing so that the male member will be continuously urged toward the notch or groove. In this manner the barrel and barrel extension will be maintained in locked position until the male member is forced out of that position in the notch by manually overriding the bias of the spring.

Figure 3:
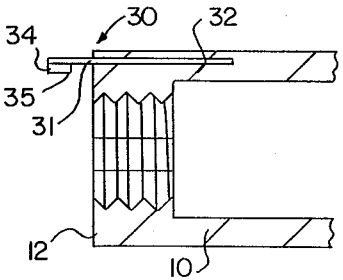
Figure 1:
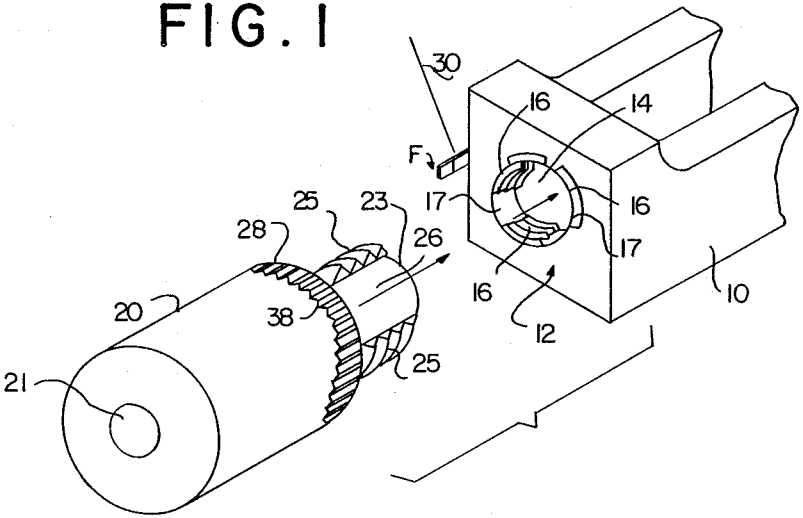

These and other objects, features and advantages of the present invention will become more fully apparent from consideration of a preferred embodiment of the invention, which is described hereinafter and illustrated in the accompanying drawings, in which:

FIG. 1 is an exploded perspective view illustrating the cooperation between the barrel and barrel extension, and FIG. 2 is an end elevational view of the barrel extension of the present invention, and FIG. 3 is a sectional view of the barrel extension illustrating an anti-rotational lock that may be employed.

Referring now to the drawings, and in particular to FIG. 1 thereof, the breech of a weapon such as an automatic machine gun terminates at one end in a barrel extension 10. Barrel extension 10 terminates outwardly in a resistance surface 12 that in this preferred embodiment is substantially planar. Extending inwardly from resistance surface 12 is a bore 14, and in the periphery of that bore are threads that are interrupted to form thread segments 16 spaced by threadless portions 17. The thread segments 16 are of helical form.

Referring to the barrel 20, it comprises a bore 21, which extends therethrough and which, when aligned with the bore 14 of barrel extension 10, permits a bullet or other projectile to pass from the barrel extension through the barrel. Barrel 20 terminates in a cylindrical protrusion 23, which has helical threads spaced around its periphery. Like the thread segments 16 of barrel extension 10, the threads of barrel 20 are interrupted to form thread segments 25 spaced by threadless portions 26. Where the barrel protrusion meets the body of the barrel 20, a surface 28 is formed, which may be termed a blocking surface, since when in fully inserted position, it is adapted to block further axial movement of the barrel 20 in the direction of the barrel extension 10.

It is a feature of the present invention that the thread portions be other than symmetrically arranged, both about the bore of the barrel extension and the protrusion of the barrel. By this means, i.e., asymmetrical arrangement, a precise alignment of the barrel can be obtained on the barrel extension. As shown in FIG. 2, the thread segments of the barrel extension, which in FIG. 1 have generally been designated by reference numeral 16, are there more specifically identified by numerals 16*a*, 16*b* and 16*c*. In a most preferred embodiment of the invention threaded segments 16*a* and 16*b* define arcs of approximately 60°, whereas threaded segment 16*c* defines an arc of approximately 62.5°. Of course, since the thread segments and threadless portions of the barrel protrusion 23 must fit within the bore 14 of barrel extension 10 in a complementary manner, two the three threadless portions of barrel protrusion 23 are define an arc a little less than 60°. The threadless portion that will complement 62.5°-sweep thread segment 16*c*, must define an arc a little greater than 62.5°. As a consequence, in order to complement the threaded segments in the core of the barrel extension, the thread segments on the barrel protrusion will be of lesser dimensions than their corresponding segments in the barrel extension bore and, conversely, the threadless portions of the barrel protrusion will be of somewhat greater dimensions than their corresponding threadless portions in that bore. Specific sizing of the thread segments and threadless portions of the barrel protrusion will be apparent to those of skill in this art.

In normal operation, the barrel 20 is to be used in cooperation with a breech terminating in barrel extension 10, another barrel having been previously removed or, in any case, the barrel extension 10 being in position for receiving barrel 20. In order to effect the cooperation of the barrel and barrel extension, normally the barrel 20 is aligned with barrel extension 10 so that barrel protrusion 26 is in axial alignment with bore 14. Then the barrel 20 is rotated until the threadless portions 26 are aligned with thread segments 16 of the barrel extension. It is preferred that the alignment only takes place in one specific position in which the barrel may be inserted into the bore 14, because the thread segments 16*a, b* and *c* of the bore 14 do not define arcs of equal dimension. As a consequence, there may be one and only one position in which the barrel protrusion 23 and its thread segments 25 may be inserted within bore 14.

Once proper alignment has been made, barrel protrusion 23 is axially inserted within bore 14 until the blocking surface 28 of the barrel is in loose contact with resistance surface 12 of the barrel extension and, concomitantly, the thread segments 16 of the barrel extension are positioned for engagement with corresponding thread segments 25 of the barrel. In this position the barrel is then rotated by approximately 60°, in which position the threads will be fully intermeshed, and being helically wound threads, the barrel will have been brought into close axial engagement with the barrel extension 10. Blocking surface 28 of the barrel will be in snug, contiguous engagement with the resistance surface 28 and no further axial movement between the barrel and barrel extension in the direction of each other can take place. The threads are sized so that such contiguity will be effected after rotation of approximately 60°.

While frictional forces will serve to maintain the barrel and barrel extension in abutting relationship after such 60°turning of the barrel, there is the possibility that upon discharge of the weapon or other uses thereof, including mishandling, the barrel may rotate in a direction in which the blocking surface and resistance surface are moved out of engagement, thus rendering the device far less accurate. In order to prevent such inadvertent disengagement, a barrel lock indicated generally by reference numeral 30 is provided. As shown in FIG. 3, barrel lock 30 comprises a substantially flat leaf spring retained within a slot 32 formed in the wall of barrel extension 10. Leaf spring 31 extends outwardly of the resistance surface 12 and terminates in a detent 34 that is substantially triangular in cross-section. Detent 34 has an inwardly extending contact edge 35 of a size and shape to fit snugly within a series of grooves or notches 38 extending around the circumference of the barrel 20.

When barrel protrusion 23 is inserted into bore 14 of barrel extension 10, leaf spring 31 is forced outwardly away from bore 14 and into a notch 38 of barrel 20. As the barrel is rotated the detent 34 and its contact edge 35 will ratchet from notch to notch until the barrel has been rotated such that blocking surface 28 and resistance surface 12 are contiguous now the detent 34 is positioned with its contact edge 35 in a single notch 38, and movement of the detent out of that groove is inhibited by the tension in leaf spring 31. When detent 34 is in its groove 38, rotary movement of the barrel is strongly deterred, not only in a direction in which the barrel and barrel extension are moved axially together, but in a direction of rotation in which they might be axially separated.

As a consequence, a device has been provided in which the barrel and barrel extension are quickly and easily engaged, ordinarily in one position of engagement only, and in which they are maintained in snug, close association by rotation until their respective facing surfaces abut, and then, against further rotation in any direction, by an additional locking means. In this manner the primary object of the present invention is achieved: a quick and easy barrel assembly and removal mechanism in which the barrel will be firmly seated on the barrel extension and in which, when the barrel is sought to be disengaged, such can be simply effected by rotating the barrel to overcome the tension of leaf spring 31, and continuing to apply rotary torque to the barrel while holding the breech steady. After rotation of about 60°, the barrel is axially removed from the barrel extension.

It will be apparent to those of skill in the art that certain variations and modifications can be made to the preferred embodiment by means of which the present invention has been illustrated and described without departing from the spirit of the invention. For example, the thread segments 16*a, b* and *c* can be incorporated on the barrel protrusion with complementary threadless portions located in the barrel extension bore. As to all such obvious alterations and modifications, it is desired that they be included within the purview of this invention, which is to be limited only by the scope, including equivalents of the following, appended claims.

What is claimed is:

1. A firearm including a barrel adapted for facile mounting on and removal from the breech thereof, comprising:

a barrel extension as part of the breech and terminating in a resistance surface adapted to maintain said barrel extension against forces exerted thereon, a bore formed in said barrel extension and extending inwardly from said resistance surface, said bore having spaced around the periphery thereof internal threads interrupted to from three thread segments extending into said bore from the periphery thereof and separated by threadless portions of the bore, two of said segments describing an arc of about 60° and the third an arc of about 62.5°, and a barrel terminating at one end in a portion protruding axially therefrom, said barrel protrusion defining a blocking surface at its juncture with said barrel end, said barrel protrusion carrying on its periphery external threads interrupted to form three thread segments extending outwardly from the periphery thereof and separated by three threadless portions of the protrusion, the thread segments of the barrel protrusion being sized to complement the threadless portions of the barrel extension bore so that the threaded end of the barrel can be inserted into the bore of the barrel extension by aligning thread segments of one with threadless portions of the other, the thread segments of the barrel and the barrel extension being so constructed that upon relative rotation of the barrel and the barrel extension when the barrel protrusion is in the bore, thread segments of each engage each other and on rotation the barrel and barrel extension are movable axially together to a position in which said barrel extension resistance surface and said barrel blocking surface are contiguous and substantially no further rotation and conjunctive axial movement between said barrel and barrel extension can take place.

2. A firearm as claimed in claim 1, in which two of the three threadless portions of the barrel protrusion describe an arc of about 60°, and the other threadless portion describes an arc of about 60.5°.

3. A firearm as claimed in claim 1, further comprising an antirotational lock having a male part extending from said barrel extension into contact with a cooperating female part on said barrel, sao that in mated position rotation between said barrel and said barrel extension is inhibited.

4. A firearm as claimed in claim 1, in which said female part carried by said barrel is a series of grooves spaced along the periphery of said barrel, each groove being shaped to cooperate with said barrel extension male member, and means to inhibit accidental release of said male member from said groove.

5. A firearm as claimed in claim 1, in which said male part carried by said barrel extension is a leaf spring biased toward the female part of said barrel when said parts are in mating position.

6. A firearm including a barrel adapted for facile mounting on and removal from the breech thereof, comprising:

a barrel extension as part of the breech and terminating in a resistance surface adapted to maintain said barrel extension against forces exerted thereon, a bore formed in said barrel extension and extending inwardly from said resistance surface, said bore having spaced around the periphery thereof internal threads interrupted to form three thread segments extending into said bore from the periphery thereof and separated by three threadless portions of the bore, and a barrel terminating at one end in a portion protruding axially therefrom, said barrel protrusion defining a blocking surface at its juncture with said barrel end, said barrel protrusion carrying on its periphery external threads interrupted to form three thread segments extending outwardly from the periphery thereof and separated by three threadless portions of the protrusion, two of the three thread segments of said barrel extension bore describing substantially equal arcs and the third of said thread segments describing a greater arc, and tow of the three threadless portions of said barrel protrusion describing arcs substantially equal to the arcs described by said substantially equal thread segments of said barrel extension bore, and the third of said threadless portions of said barrel protrusion describing a greater arc substantially equal to that described by said third thread segment of said barrel extension bore, so that the threaded end of the barrel can be inserted into the bore of the barrel extension by aligning thread segments of one with threadless portions of the other, the thread segments of the barrel and the barrel extension being so constructed that upon relative rotation of the barrel and the barrel extension when the barrel protrusion is in the bore, thread segments of each engage each other and on relative rotation the barrel and barrel extension are movable axially together to a position in which said barrel extension resistance surface and said blocking surface are contiguous and substantially no further rotation and conjunctive axial movement between said barrel and barrel extension can take place.

7. A firearm as claimed in claim 6, in which the two substantially equal arcs of thread segments of said barrel extension bore subtend angles of about 60° and the greater thread segment arc subtends an angle of about 62.5°.

8. A firearm as claimed in claim 6, in which the threads of said barrel extension bore and said barrel protrusion are helical threads.

9. A firearm as claimed in claim 6, further comprising an antirotational lock having a male part extending from said barrel extension into contact with a cooperating female part on said barrel, so that in mated position rotation between said barrel and said barrel extension is inhibited.

10. A firearm including a barrel adapted for facile mounting on and removal from the breech thereof, comprising:

a barrel extension as part of the breech and terminating in a resistance surface adapted to maintain said barrel extension against forces exerted thereon, a bore formed in said barrel extension and extending inwardly from said resistance surface, said bore having spaced around the periphery thereof internal threads interrupted to form three thread segments extending into said bore from the periphery thereof and separated by three threadless portions of the bore, and a barrel terminating at one end in a portion protruding axially therefrom, said barrel protrusion defining a blocking surface at its juncture with said barrel end, said barrel protrusion carrying on its periphery external threads interrupted to form three thread segments extending outwardly from the periphery thereof and separated by three threadless portions of the protrusion, two of the three thread segments of said barrel protrusion describing substantially equal arcs, and the third of said thread segments describing a greater arc, and tow of the three threadless portions of said barrel extension bore describing arcs substantially equal to the arcs described by said substantially equal thread segments of said barrel protrusion, and the third of said threadless portions of said barrel extension bore describing a greater arc substantially equal to that described by said third thread segment of said barrel protrusion, so that the threaded end of the barrel can be inserted into the bore of the barrel extension by aligning thread segments of one with threadless portions of the other, the thread segments of the barrel and the barrel extension bore being so constructed that upon relative rotation of the barrel and the barrel extension when the barrel protrusion is in the bore, thread segments of each engage the other and on relative rotation the barrel and barrel extension are movable axially together to a position in which said barrel extension resistance surface and said barrel blocking surface are contiguous and substantially no further rotation and conjunctive axial movement between said barrel and barrel extension can take place.

11. A firearm as claimed in claim 10, in which the two substantially equal arcs of thread of said protrusion subtend angles of about 60° and the greater thread segment arc subtends an angle of about 62.5°.

12. A firearm as claimed in claim 10, in which the threads of said barrel extension bore and said barrel protrusion are helical threads.

13. A firearm as claimed in claim 10, further comprising an antirotational lock having a male part extending from said barrel extension into contact with a cooperating female part on said barrel, so that in mated position rotation between said barrel and said barrel extension is inhibited.

* * * * *